US006038798A

United States Patent [19]

Liu

[11] Patent Number: 6,038,798

[45] Date of Patent: Mar. 21, 2000

[54] INTERNAL ROTARY STRUCTURE OF A CRYSTAL BALL SEAT

[76] Inventor: Jack Liu, No.3, Alley 202, Kao-Fon Rd., Hsin-Chu City, Taiwan

[21] Appl. No.: 08/976,457

[22] Filed: Nov. 25, 1997

[51] Int. Cl.[7] ..... G09F 19/08

[52] U.S. Cl. ..... 40/411; 74/416; 74/410; 84/95.2

[58] Field of Search ..... 40/409, 410, 411, 40/414; 446/243, 408; 84/94.1, 94.2, 95.1, 95.2; 74/416

[56] References Cited

U.S. PATENT DOCUMENTS 3,082,570 3/1963 Pearson, Jr. ..... 40/411 X
4,344,243 8/1982 Reszka ..... 40/414 X
5,339,923 8/1994 Chen ..... 40/411 X
5,555,656 9/1996 Liu ..... 40/411
5,620,353 4/1997 Lai ..... 40/410 X
5,675,921 10/1997 Lin ..... 40/409

*Primary Examiner*—Brian K. Green
*Attorney, Agent, or Firm*—Smith, Gambrell & Russell, LLP

[57] ABSTRACT

An internal rotary structure of a crystal ball seat having a base plate, a rotary disk, gears and other components; characterized in that: a circular platen is formed on the center of the upper surface of the base plate; a rotary disk is installed on the periphery of the platen of the base plate; circular teeth formed on the inner rim of the rotary disk, and a driving gear of longitudinal axis is installed below the driving gear of the music bell rolling wheel. By this structure, in a small space, the rotary disk may be used to drive the music bell.

13 Claims, 3 Drawing Sheets

INTERNAL ROTARY STRUCTURE OF A CRYSTAL BALL SEAT

BACKGROUND OF THE INVENTION

1. Field of the invention

The present invention relates to an internal rotary structure of a crystal ball seat, and particularly, to a crystal ball seat having an internal rotary disk which is quite small.

2. Description of the Prior Art

A music bell decoration, and especially, the inner part of the seat of which is installed with a rotary disk or a rotary cylinder, for example, as in U.S. Pat. No. 5,555,656, is discussed. As shown in said Patent Application, a gear is installed on the edge portion of the transversal rolling wheel of the music bell so that the cylinder within a substrate may be driven by said gear, and the user may observe the rotation of the cylinder with decoration from the outside of the substrate.

However, in order that the transversal gear may be engaged with the circular teeth on the inner teeth of the cylinder in a correct position, therefore, the roller axis of said music bell needs to be located on the diameter position of the rotary cylinder, as shown in the FIG. 4 of said Patent Application. By the confinement of said music bell, the whole music bell is on one side of the cylinder, thus the inner diameter must be enlarged so that the music bell may be contained therewithin.

The container of the aforementioned cylinder must be enlarged due to the installation of the music bell, Therefore, the seat of the crystal ball must also be enlarged, so that, for a smaller size music bell decoration, said structure of the Patent Application must not be employed.

SUMMARY OF THE INVENTION

Accordingly, the present invention provides an internal rotary structure of a crystal ball seat, the main components of which are a base plate, a rotary disk, gears and other components, wherein a music bell is fixed on the platen of the base plate, and a rotary disk is installed on the rim portion of said platen of the base plate. Further, a driving gear with longitudinal axis is installed between the driving gear of the music bell rolling wheel and the circular teeth on the inner rim of the rotary disk.

By said structure, since said driving gear has a longitudinal type, therefore, even the music bell is installed on the central position of the platen of the base plate. Said driving gear is also driven to rotate by a driven rotary disk which is operable in the horizontal direction.

Since the music bell of the present invention may be installed on the central position of the base plate platen, therefore, said rotary disk may be used as the power source of the music bell for driving said music bell to rotate. Accordingly, the structure of the present invention is fitted to be employed in the decoration of a music bell with a small size.

The present invention will be better understood and its numerous objects and advantages will become apparent to those skilled in the art by reference to the following drawings in which:

Numbers of Components:

| | | | |
|---|---|---|---|
| 1 | base plate | 11 | platen |
| 12 | slot | | |
| 2 | rotary disk | 21 | circular teeth |
| 22 | decoration | | |
| 3 | music bell | 31 | rotary disk |
| 32 | driving gear | 33 | notch |
| 34 | winding axis | | |
| 4 | driving gear | 41 | crown teeth |
| 42 | positive gear | | |
| 5 | linkage gear | | |
| 6 | seat | | |
| 7 | external rotary disk | | |
| 8 | central gear | | |
| 9 | sub-gear | | |

DETAILED DESCRIPTION OF THE PREFERRED EMBODIMENT

Figure 1:
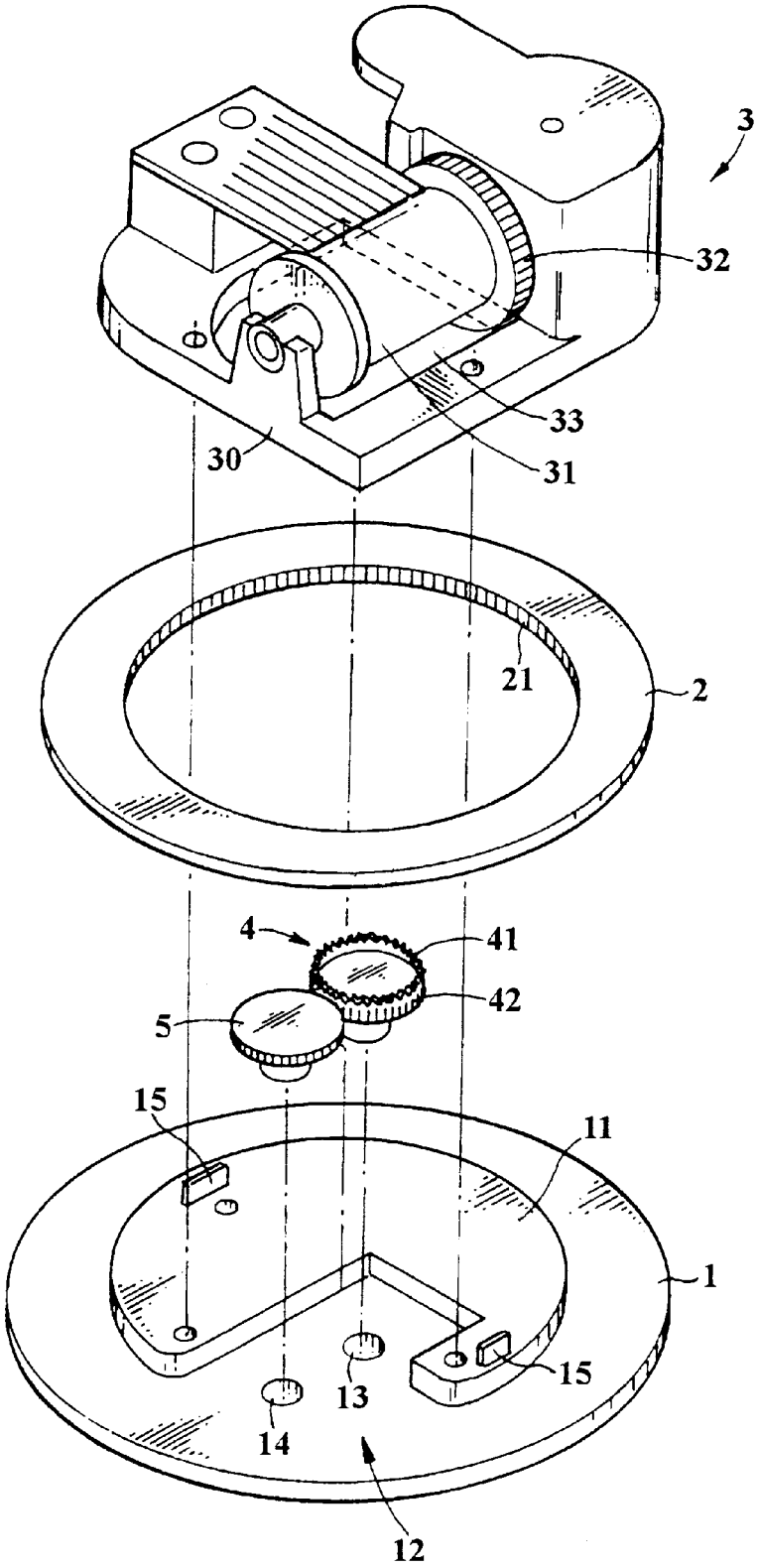
FIG. 1 is a schematic perspective view of the present invention.
Figure 2:
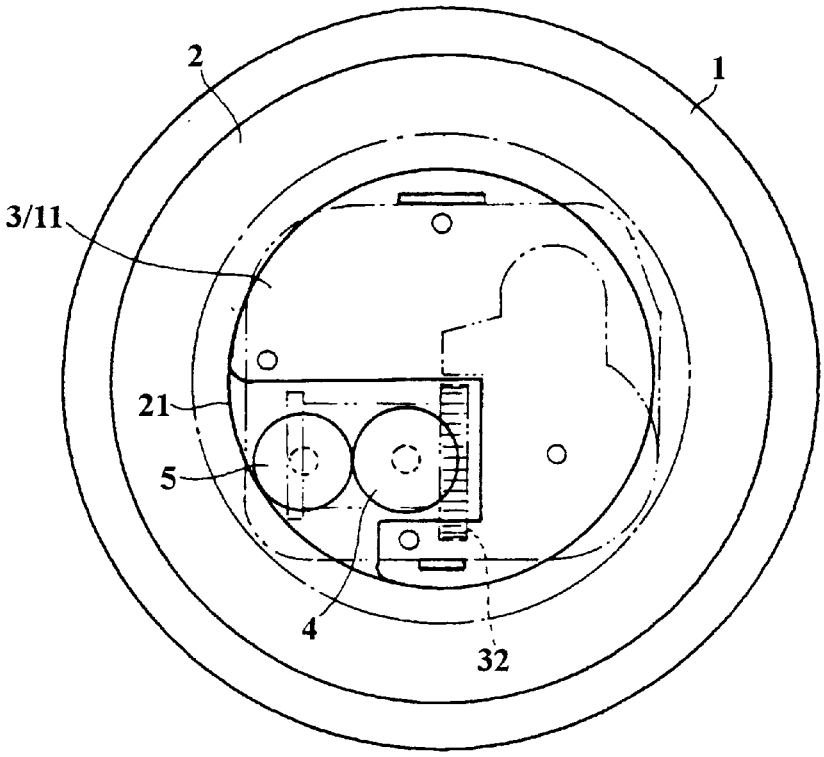
FIG. 2 is an elevational view of FIG. 1.
Figure 3:
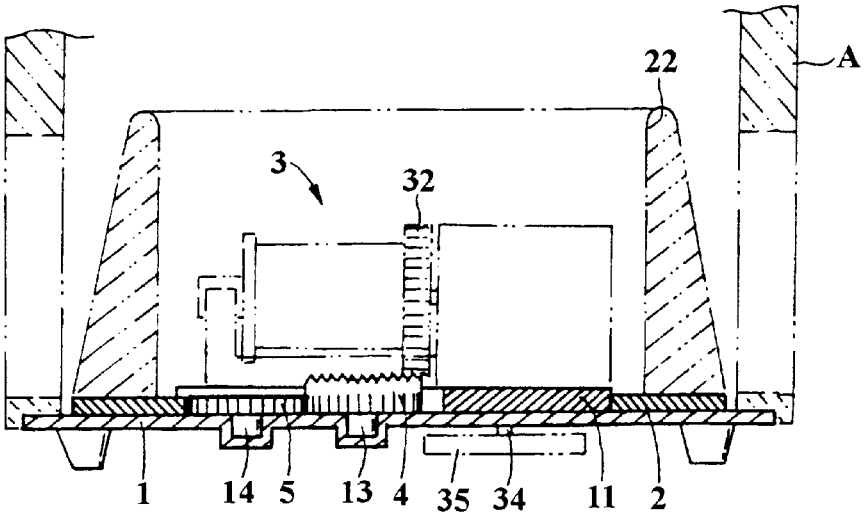
FIG. 3 is a front cross sectional view of FIG. 1.

The detail description of rotary structure of the present invention is shown in FIGS. 1, 2 and 3. The present invention includes a base plate (1), a rotary disk (2), gears and other components; wherein a circular platen (11) is formed on the center of the upper surface of the base plate (1) and a music bell (3) is fixed on the center of the platen(11).

A projected positioning plate (15) is installed on the rim of the music bell seat (30) with respect to the platen (11). The positioning plate (15) allows the music bell (3) may be assembled quickly in the predetermined position of the platen (11).

The music bell (3) is a conventional product and the power source thereof is a conventional winding and a notch (33) is formed on the music bell seat (30) below the transversal rolling wheel (31) of the music bell.

A slot (12) aligned with the base plate (1) is formed on the base plate platen (11) with respect to the notch (33) of the music bell.

Further, a rotary disk (2) is installed on the periphery of the platen (11) of the base plate (1) so that the rotary disk (2) may be rotated around the platen (11), and the height of the rotary disk (2) will not exceed the height of the platen (11) and circular teeth (21) are formed on the inner rim of the rotary disk (2).

In this embodiment, a cylindrical decoration with proper height is fixed on the disk surface of said rotary disk (2) and as a rule, the inner rim of the decoration will not contact the components of the music bell (3).

Further, a driving gear (4) of longitudinal axis is installed below the driving gear (32) of the music bell rolling wheel (31), the driving gear (4) is rotated around the axial hole (13) of the base plate slot ( 12) .

Crown teeth (41) orthogonal to the driving gear (32) of the music bell rolling wheel (31) are formed on the upper end of the driving gear (4).

The crown teeth (41) of the driving gear (4) pass through the notch (33) of the music bell seat (30) and then engage the driving gear (32), so that, the power of the music bell (3) will cause the driving gear (4) to be rotated through said driving gear (32).

Moreover, a linkage gear (5) the rotary center of which is axial hole (14) is installed between the positive gear (42) of the driving gear (4) and the periphery circular teeth (21), then said driving gear (4) will drive rotary disk (2) through the linkage gear (5) to rotate synchronously.

Said driving gear (4) and the linkage gear (5) are all located in the base plate slot (12), and the height of the linkage gear (5) will not be greater than the height of the platen (11).

Since said rotary disk (2) will be driven to rotate, the dynamic phenomenon from the rotating of the decoration (22) installed on the rotary disk (2) may be observed from the outside of the crystal ball seat (A) through an opening.

Figure 4:
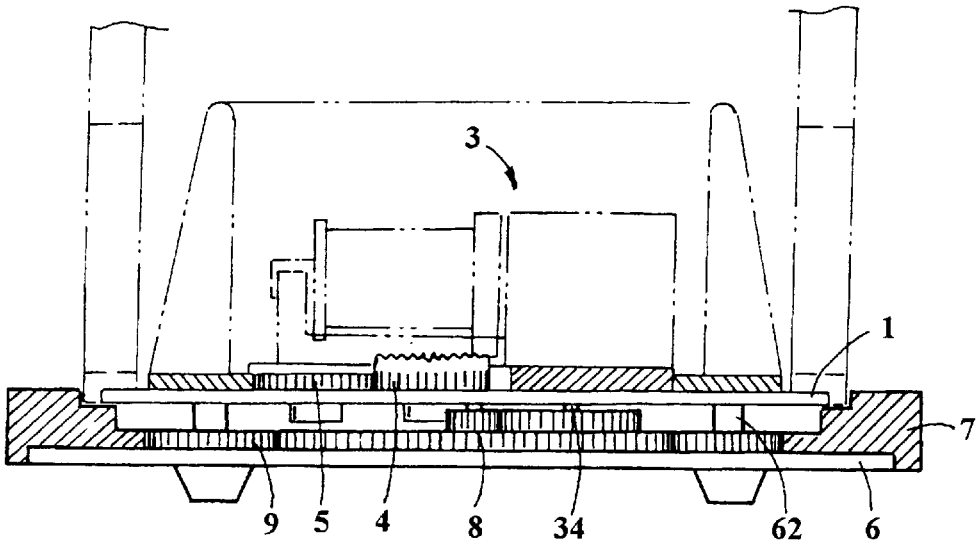
FIG. 4 is a front cross sectional view of a modified embodiment in the present invention.
Figure 5:
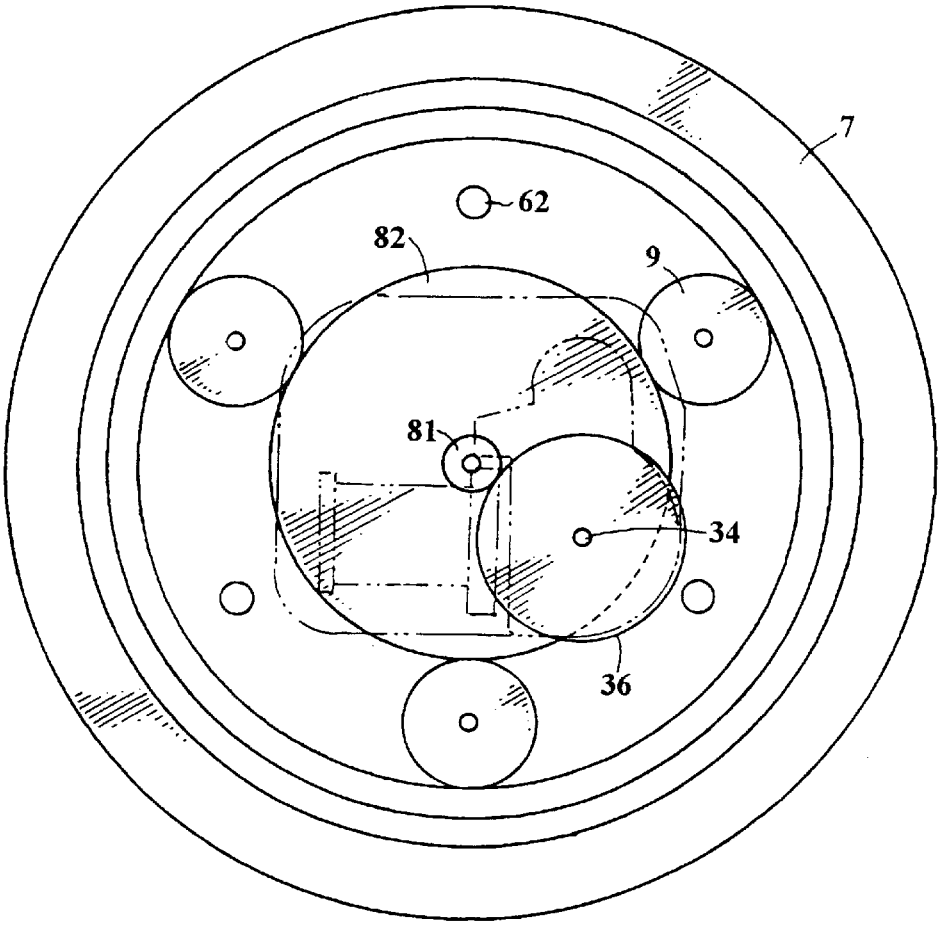
FIG. 5 is an elevational view of FIG. 4.

The power of the music bell (3) within the crystal ball is derived by rotating the spanner (35) under the base plate (1) by operator so that the winding (34) is driven to rotate. In order to further extend the application of said structure, another modified embodiment is shown in FIGS. 4 and 5.

Said spanner (35) on said winding (34) is replaced by a main gear (36).

A seat (6) is installed under the base plate (1), and a plurality of upright pillars (62) are installed about the periphery of said seat (6).

By said longitudinal pillars (62), the seat (6) may be fixed to the base plate (1) with a gap defined therebetween.

Further, an annular external rotary disk (7) is installed within the gap between the seat (6) and the base plate (1). The outer radius of the external rotary disk (7) is larger than that of the crystal ball substrate (A), and teeth (71) are formed on the periphery of the inner radius thereof.

Further, a central gear (8) is on the center of the seat, and said central gear (8) is divided into an upper gear (81) and a lower gear (82), wherein said upper gear (81) is engaged with the main gear (36) of said winding axis (34).

Furthermore, a plurality of sub-gears (9) are installed between the lower gear (82) of the central gear (8) and the circular teeth (71) of the external rotary disk (7). As the external disk (7) is rotated by the force applied by an operator on the preset direction, then by the linkage of the teeth (71) of the external disk (7) with the sub-gears (9) and the central gear (8), the main gear (36) may be driven to rotate synchronously, and the winding axis (34) will rotate so that the music bell (3) will derive power.

If enough power is inputted to said music bell (3) and the force is stopped by the operator, then during the process that the power is released by music bell (3), the winding axis will rotate inversely, and the power will be transferred through the main gear (36), the central gear (8) and the sub-gears (9) so that said external rotary disk (7) will be driven to rotate to present another dynamic phenomenon.

According to said structure, the rotating orientation of the external rotary disk (7) is inverse to that of said rotary disk (2).

In order to simplify said structure, the pillars (62) of the seat (6) may be rotational axes of said sub-gear.

Although certain preferred embodiments of the present invention have been shown and described in detail, it should be understood that various changes and modifications may be made therein without departing from the scope of the appended claims.

What is claimed is:

1. An internal rotary structure of a crystal ball seat, comprising:

a base plate having an upper and a lower surface thereof and having a circular platen formed on said upper surface thereof, said base plate having a first hole defamed therein a music bell having a base portion and a rolling wheel with a driving gear installed on said base portion, said music bell being fixed on said platen of said base plate;

a rotary disk installed about a periphery of said platen of said base plate, said rotary disk having gear teeth on an inner rim thereof;

a driving gear installed in said first hole of said base plate, said driving gear of said base plate having a positive gear on a side thereof, and a crown gear on an upper surface thereof, said crown gear being orthogonal to said driving gear of said music bell and engaged therewith; and linkage means linking said driving gear of said base plate with said gear teeth of said inner rim of said rotary disk, whereby rotation of said driving gear of said music bell drives said driving gear of said base plate, which drives said linkage means, which in turn drives said rotary disk.

2. The internal rotary structure of a crystal ball seat according to claim 1, wherein said platen of said base plate has a slot defined therein, said first hole in said base plate being within said slot, wherein said base plate of said music bell has a notch defined therethrough and disposed above said slot of said platen on said base plate.

3. The internal rotary structure of a crystal ball seat according to claim 1, wherein said driving gear of said base plate is installed beneath said driving gear of said rolling wheel of said music bell.

4. The internal rotary structure of a crystal ball seat according to claim 1, wherein said driving gear of said base plate is rotatable about the first hole of said base plate.

5. The internal rotary structure of a crystal ball seat according to claim 4, wherein said base plate has a second hole defined therethrough, and wherein said linkage means comprises a linkage gear installed in said second hole of said base plate and rotatable therein, said linkage gear having positive gear on a side thereof, said positive gear of said linkage gear engaged both with said positive gear of said driving gear on said base plate, and with said gear on said inner rim of said rotary disk.

6. The internal rotary structure of a crystal ball seat according to claim 5, wherein said driving gear of said base plate and said linkage gear are both located in said slot of said platen on said upper surface of said base plate.

7. The internal rotary structure of a crystal ball seat according to claim 5, wherein a height of said linkage gear does not exceed a height of said platen above said base plate.

8. The internal rotary structure of a crystal ball seat according to claim 1, wherein a positioning tab projects from an upper surface of said platen of said base plate.

9. The internal rotary structure of a crystal ball seat according to claim 1, wherein a decoration is fixed on an upper surface of said rotary disk.

10. The internal rotary structure of a crystal ball seat according to claim 1, wherein a height of said rotary disk does not exceed a height of said platen above said base plate.

11. The internal rotary structure of a crystal ball seat according to claim 1, wherein said rotation of said linkage means rotatably drives said rotary disk in a direction of rotation opposite that of said driving gear of said base plate.

12. The internal rotary structure of a crystal ball seat according to claim 1, further comprising:

a seat, having an upper surface and a lower surface, positioned beneath said base plate and attached to said lower surface of said base plate, such that a gap is defined between said seat and said base plate;

a central gear, in a center of said seat, divided into upper and lower gear portions, wherein said upper gear portion has a smaller diameter than said lower gear portion;

a rotary winding disk, within the gap defined between said base plate and said seat, and extending beyond an outside edge of said base and of said seat a plurality of sub-gears, positioned about the periphery of said seat, said sub-gears being engaged with said lower gear portion of said central gear, and with said gear of said inner rim of said rotary winding disk; and a winding axis gear, having a central axial portion engaged with a winding means for said music bell, and an outer gear engaged with the upper gear portion of said central gear, such that when an operator forcefully rotates the portion of the rotary disk extending beyond the outside edges of said base and of said seat in a preset direction, such rotation of said rotary disk rotatably drives said sub-gears, which in turn rotatably drives said central gear, which rotatably drives said winding axis gear, so that the operator thereby winds said music bell.

13. The internal rotary structure of a crystal ball seat according to claim 12, wherein a plurality of upright pillars project from the upper surface of said seat and contact said base plate within said gap.

* * * * *